United States Patent [19]

Jahnke

[11] Patent Number: 4,533,481

[45] Date of Patent: Aug. 6, 1985

[54] POLYCARBOXYLIC ACID/BORIC ACID/AMINE SALTS AND AQUEOUS SYSTEMS CONTAINING SAME

[75] Inventor: Richard W. Jahnke, Mentor-on-the-Lake, Ohio

[73] Assignee: The Lubrizol Corporation, Wickliffe, Ohio

[21] Appl. No.: 486,638

[22] Filed: Apr. 20, 1983

[51] Int. Cl.[3] ..... C10M 3/48

[52] U.S. Cl. ..... 252/49.6; 260/462 R; 252/49.3; 252/389 R; 252/392; 564/8

[58] Field of Search ..... 252/49.6, 49.3, 389.41; 260/462 R; 564/8

[56] References Cited

U.S. PATENT DOCUMENTS

| | | | |
|---|---|---|---|
| 2,052,192 | 8/1936 | Figgett | 260/33 |
| 2,216,618 | 10/1940 | Kats | 260/401 |
| 2,999,064 | 9/1961 | Sluhan | 252/49.6 |
| 3,024,197 | 3/1962 | Dohr et al. | 252/117 |
| 3,113,106 | 12/1963 | Klass et al. | 252/49.6 |
| 3,133,951 | 5/1964 | Nutzel et al. | 260/462 |
| 3,429,909 | 2/1969 | Schuster | 252/49.6 |
| 3,544,614 | 12/1970 | Schwartz | 252/49.6 |
| 4,144,188 | 3/1979 | Sato | 252/389 |
| 4,209,414 | 6/1980 | Holgado et al. | 252/75 |
| 4,226,734 | 10/1980 | Schuster | 252/49.6 |
| 4,313,837 | 2/1982 | Vakasovich et al. | 252/49.5 |
| 4,331,545 | 5/1982 | Papay et al. | 252/49.6 |

*Primary Examiner*—Jacqueline V. Howard

*Attorney, Agent, or Firm*—Walter C. Danison, Jr.; Denis A. Polyn; Raymond F. Keller

[57] ABSTRACT

Inhibitors useful in preventing the corrosion of metal surfaces that contact aqueous systems containing them are disclosed. The inhibitors comprise mixtures of monoamine salts of polycarboxylic acids and boric acid. Typical corrosion inhibitors are made from acids such as dodecanedioic, sebacic and azelaic acid, monoamines such as mono-, di- and triethanol amines and boric acid.

19 Claims, No Drawings

POLYCARBOXYLIC ACID/BORIC ACID/AMINE SALTS AND AQUEOUS SYSTEMS CONTAINING SAME

BACKGROUND OF THE INVENTION

1. Field of the Invention

This invention relates to corrosion inhibitors which prevent corrosion of metal surfaces contacted by aqueous compositions containing them. More particularly the invention relates to corrosion inhibitors which are amine salts of mixtures of polycarboxylic acids and boric acid. The invention also relates to aqueous systems containing the aforedescribed corrosion inhibitors and methods of inhibiting corrosion of metal which comprises contacting metal with said aqueous systems.

2. Prior Art

It is known to treat aqueous systems, such as functional fluids (e.g., machining and hydraulic fluids), with corrosion inhibitors to prevent unwanted corrosion of metal surfaces which come in contact with the systems. For example, strongly alkaline systems are used for temporary corrosion inhibition during the production of metal work pieces, during or after cleaning treatments and during machining or at other stages of processing. Typical of the known corrosion inhibitors used in such systems are the alkali metal nitrites and chromium salts. Organic compounds such as alkanol amines, particularly tri-alkanol amines and alkyl or alkanol amine soaps of fatty acids also have been used.

The systems containing nitrites and chromates have the disadvantage that special steps must be taken to prevent their release into waste water without removal of the nitrites or chromates. In addition, certain nitrite-containing materials are suspected carcinogens. Alkanol amines and fatty acid salts have frequently been found to be inadequate corrosion inhibitors requiring the use of excessive levels or supplementary additions of chromate or nitrite. Therefore the need for effective, non-polluting corrosion inhibitors for aqueous systems has continued.

Efforts to meet this need have resulted in research described in several patents. For example: U.S. Pat. No. 4,113,498 discloses corrosion inhibitors comprising a reaction product of an aliphatic carboxylic acid, a polyhydroxy carboxylic acid and an alkanol amine.

U.S. Pat. No. 4,053,426 and British Patent Specification 1,532,836 describe water-based, metal working fluids containing amine salts of a partial ester of an alkenyl or alkyl succinic acid.

Japanese Patent Application 156,684, as abstracted in Derwent publications abstract number 59567A/33*j5 3079–738, discloses water-soluble corrosion inhibitors for steel containing a carboxylic acid and an amino alcohol.

U.S. Pat. No. 2,726,215 discloses alkali and alkaline earth metal salts of dicarboxylic acids and their use in aqueous systems as corrosion inhibitors.

U.S. Pat. No. 2,638,449 discloses reaction products of fatty acids and dialkanol amines which are further reacted with alkenyl succinic acids having substituents of up to 31 carbon atoms.

U.K. Patent Application 1,521,984, as abstracted in Derwent publications, abstract number J5014W–52, describes detergents made by reacting adipic or sebacic acid with mono-, di- or triethanol amine and adjusting the pH of the reaction product to 7–7.5 with amine. The product is described as being soluble in water.

U.S. Pat. No. 4,120,665 describes water-soluble complex salts of certain metals, hydroxycarboxylic acids and phosphoric esters of alkanol amines and their use as corrosion inhibitors.

U.S. Pat. No. 4,250,042 describes salts of polycarboxylic acids and ammonia. These salts are reported to be useful as metal corrosion inhibitors in aqueous systems and particularly in well-drilling operations.

U.S. Pat. No. 2,441,063 describes salts of alkylolamine boric esters. Generally, the salts are prepared by reacting an alkylolamine and a borating agent to form a boric ester of the amine which is then reacted with a carboxylic acid.

Mixtures of salts of monocarboxylic acids and amines with boric acid and amine are described in U.S. Pat. No. 2,999,064. Such salts are reported to be useful in aqueous cutting fluids as corrosion inhibitors.

In U.S. Pat. No. 3,282,955, reaction products of acylated nitrogen intermediates with a boron compound are described. The acylated nitrogen intermediates are formed by the reaction of a hydrocarbon substituted succinic acid and a hydroxy amine. The products are useful as additives in lubricating oils.

SUMMARY OF THE INVENTION

It has now been found that useful inhibitors of metal corrosion for use in aqeous systems comprise at least one water-soluble, mono amine boron carboxylate salt made from at least one polycarboxylic acid (I) corresponding to the formula:

$$R(COOH)_{2-3} \quad (I)$$

wherein R is an alkylene or monohydroxy alkylene group of about 4 to about 25 carbons, at least one mono amine (II) corresponding to the formula:

$$(R')_3N \quad (II)$$

wherein each R′ is independently hydrogen, $C_{1-20}$ hydrocarbyl or a $C_{2-20}$ hydroxyl hydrocarbyl group, a boron compound such as boric acid, boron trioxide, boron halide and esters of boric acid.

Aqueous systems containing the aforedescribed inhibitors and methods of inhibiting corrosion of metal using them are also in the scope of the invention. The inhibitor salts of this invention are water-soluble; this means they have a solubility in water at 25° C. of at least 0.1 gm per liter.

DETAILED DESCRIPTION OF THE INVENTION

The Polycarboxylic Acid (I):

The polycarboxylic acids used to make the inhibitors of the present invention can be represented by the formula:

$$R(COOH)_{2-3} \quad (I)$$

wherein R is an alkylene, alkenylene, alkynylene or hydroxyl alkylene group of about 4 to about 25 carbons, and preferably from 4 to 15 carbon atoms. Typical alkylene groups are the butylene groups such as the 1,2-, 1,3- and 1,4-normal butylene groups, the branched butylene groups and higher homologs thereof up to groups containing about 25 carbons. Often R is unbranched polymethylene group such as 1,5-pentylene group, 1,6-hexylene group, 1,7-heptylene group, etc.

Usually, the acid is a dicarboxylic acid although tricarboxylic acids are useful.

The alkenylene groups are analogous to the alkylene groups except they contain a double bond. The hydroxyl alkylene groups are similarly analogous to the alkylene groups except a single hydroxyl group is present.

Typically R is an unbranched polymethylene group; often it is an alkylene group of 4 to 10 carbon atoms or a polymethylene group of similar size. Specific examples of the acid (I) are sebacic, azelaic, suberic, pimelic, adipic, glutaric, 1,12-dodecanedioic acid, 1,14-hexadecanedioic acid, various commercial dicarboxylic acids such as a linoleic acrylic dimer available from Westvaco Chemical Co. under the general trade designation "1550 Diacid", 1,2,4-dodecanetrioic acid and the like. Dodecanedioic acid, sebacic acid, azelaic acid and mixtures of one or more of these acids are the preferred dicarboxylic acids. Mixtures of two or more such acids can also be successfully used.

The Monoamine (II):

The monoamines useful in preparing the boron and carboxylate salts of this invention can be represented by the general formula $$(R')_3N \qquad (II)$$

wherein each R′ is independently hydrogen, a $C_{1-20}$ hydrocarbyl or a $C_{2-20}$ hydroxyl hydrocarbyl group. When all the R′ groups are hydrogen, the amine is ammonia. In other instances the amine is a primary, secondary or tertiary amine. The hydrocarbyl groups may contain from 1 to 20 carbon atoms, but preferably will contain from 1 to 3 or 4 carbon atoms since the products obtained from such amines should be characterized by improved water-solubility. Preferably, at least one R′ is a hydroxyl alkyl group, and each hydrocarbyl group also will preferably have no more than 3 or 4 carbon atoms. Specific examples of such hydroxy alkyl amines are ethanol amine, diethanol amine, tri-ethanol amine, propanol amine, di(propanol) amine, tri(propanol) amine, N,N-di(lower alkyl) ethanol or propanol amine (where the alkyl group has up to seven carbon atoms) and the like. With the propanol amines, both the 1,2- and 1,3- isomers are contemplated.

In the invention's broader scope, the monoamine (II) can be aliphatic, alicyclic, aromatic or heterocyclic in nature as long as the final salt product is water-soluble. These include aliphatic-substituted aromatic, aliphatic-substituted alicyclic, aliphatic-substituted heterocyclic, alicyclic-substituted aliphatic, alicyclic-substituted aromatic, alicyclic-substituted heterocyclic, aromatic-substituted aliphatic, aromatic-substituted alicyclic, aromatic-substituted heterocyclic, heterocyclic-substituted aliphatic, heterocylic-substituted alicyclic, and heterocyclic-substituted aromatic amines which may be saturated or unsaturated. If unsaturated, the amine will be free from acetylenic unsaturation (i.e., —C≡C—).

Aliphatic monoamines include mono-, di- and trialiphatic substituted amines wherein the aliphatic groups can be saturated or unsaturated and straight or branched chain. Thus, they are primary, secondary or tertiary aliphatic amines. Such amines include, for example, mono-, di- and trialkyl-substituted amines, mono-, di- and trialkenyl-substituted amines, and amines having one or two N-alkenyl substituents, one or two N-alkyl substituents and the like. The total number of carbon atoms in these aliphatic monoamines will normally not exceed about 40 and usually not exceed about 20 carbon atoms. Specific examples of such monoamines include ethyl methyl amine, diethyl amine, n-butyl amine, di-n-butylamine, tri-n-butyl amine, allyl amine, isobutyl amine, cocoamine, stearyl amine, lauryl amine, methyl lauryl amine, oleyl amine, N-methyl N-octyl amine, dodecyl amine, octadecyl amine, and the like. Examples of alicyclic-substituted aliphatic amines, aromatic-substituted aliphatic amines, and heterocyclic-substituted aliphatic amines, include 2-(cyclohexyl)ethyl amine, benzyl amine, phenyl ethyl amine, 3-(furylpropyl) amine and the like.

Alicyclic monoamines are those monoamines wherein there is an alicyclic substituent attached directly to the amino nitrogen through a carbon atom in the cyclic ring structure. Examples of alicyclic monoamines include cyclohexyl amine, cyclopentyl amine, cyclohexenylamine, cyclopentenylamines, N-ethylcyclohexyl amine, dicyclohexyl amine, and the like. Examples of aliphatic-substituted, aromatic-substituted, and heterocyclic-substituted alicyclic mono-amines include propyl-substituted cyclohexyl amines, phenyl-substituted cyclopentyl amines, and pyranyl-substituted cyclohexyl amine.

Suitable aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthylene. Examples of aromatic monoamines include aniline, di(-para-methylphenyl) amine, naphthyl amine, N-(n-butyl) aniline, and the like. Examples of aliphatic-substituted, alicyclic-substituted, and heterocyclic-substituted aromatic monoamines are paraethyl aniline, para-dodecyl aniline, cyclohexyl-substituted amine, and thienyl-substituted aniline.

Heterocyclic mono-amines can also be used in making the carboxylate salts of this invention. As used herein, the terminology "heterocyclic mono-amine(s)" is intended to describe those heterocyclic amines containing at least one primary or secondary amino group and at least one nitrogen as a heteroatom in a heterocyclic ring. Heterocyclic amines can be saturated or unsaturated and can be substituted with alkyl, alkenyl, aryl, alkaryl or aralkyl substituents. Generally, the total number of carbon atoms in the substituents will not exceed about 20. Heterocyclic amines can contain heteroatoms other than nitrogen, especially oxygen and sulfur. Obviously they can contain more than one nitrogen heteroatom. The five- and six-membered heterocyclic rings are preferred.

Among the suitable heterocyclics are aziridines, azetidines, azolidines, pyrrolidine, pyridine, tetra- and di-hydro pyridines, pyrroles, indoles, quinoline, picolines, piperidine and the like. Mixtures of two or more of these heterocyclic amines can be used. Typical heterocyclic amines are the saturated five- and six-membered heterocyclic amines.

As will be appreciated by those of skill in the art, when the monoamine (II) is an alicyclic or heterocyclic amine, two (or more) of the R′ groups can be joined together. As noted above hydroxyl substituted analogs of all the above-described monoamines can be also used in the invention. Similarly mixtures of such analogs and mixtures of one or more analogs with one or more of the above-described mono-amine can be used.

The Boron Compound:

The third reagent used in the preparation of the inhibitors of this invention is a boron compound capable of reacting with the amine to form an amine salt. Thus, the boron compound may be least one of boric acid, boron trioxide ($B_2O_3$), boron halides (especially boron trichloride, $BCl_3$) and esters of boric acid. Boron trioxide will react first with water which is present in the reaction mixture to form boric acid, which then reacts further. Any of the various forms of boric acid may be used, including metaboric acid ($HBO_2$), orthoboric acid ($H_3BO_3$) and tetraboric acid ($H_2B_4O_7$). The esters of these acids include, for example, the methyl, ethyl and propyl esters, with the methyl esters being most readily available and therefore most often used. Boric acid, and especially orthoboric acid, is preferred.

The Reaction of the Polycarboxylic Acid (I), the Monoamine (II) and the Boron Compound:

The inhibitor salts of this invention are formed by neutralizing the polycarboxylic acid (I) and the boron acid with the amine (II). This neutralization can be carried out in a separate step before formulation of the aqueous system or it can be in situ during formulation of the aqueous system by adding the carboxylic and boric acid(s) and the amine(s) to the aqueous system. Usually the free acid is used although metal salts can be used especially when the amine (II) is in the form of an ammonium salt of a mineral acid. The reaction generally and preferably is conducted in the presence of water, but its presence is not essential; other solvent/diluents can be used such as lower alkanols, ethers and the like.

Usually about one mole of amine (II) is included for each equivalent of polycarboxylic acid (I) (an equivalent of acid is its molecular weight divided by the number of carboxylic groups in its structure) and of boric acid in the reaction mixture. In determining acid equivalent weight, an anhydride group, if present, is counted as two carboxylic acid groups. Thus, the amount of amine used in the reaction generally will be an amount in slight excess of that needed to neutralize all of the polycarboxylic acid and boric acid present. For example, the present invention contemplates the use of mixtures comprising 15–30% by weight of polycarboxylic acids, 5–20% by weight of boron acid, 40–55% by weight of mono amine and the remainder is water. Generally from 10–30% of the mixture is water. On an equivalent basis, optimum results are obtained with the relative amounts of reactants are maintained at about 1.5–2.5 equivalents of boric acid: 0.5–1.5 equivalents of polycarboxylic acid: 2.5–3.5 equivalents of amine.

The corrosion inhibitor salts of the invention are prepared by mixing the reactants in water at temperatures below 100° C. Generally, temperatures of from 60°–75° C. are sufficient for producing the desired salts.

The following examples more fully describe the inhibitor salts of the present invention and show how they are prepared. These examples are intended to be merely illustrative and should not be construed as being limiting in any way. Unless otherwise indicated, all parts and percentages are by weight, and all temperatures are in degrees centigrade.

EXAMPLE 1

A mixture of 405 parts of boric acid and 800 parts of water is prepared, and 1333 parts of ethanolamine are added over a period of 30 minutes. The temperature of the mixture rises to about 60° C. and is maintained at 62°–65° C. for an additional 45 minutes. Dodecanedioic acid (533 parts), 155 parts of sebacic acid and 251 parts of azelaic acid are added to the mixture in 12 minutes and the temperature of the mixture reaches 72° C. Ethanolamine (523 parts) is added over a period of 18 minutes and the mixture is maintained at 65°–72° C. for one hour. The mixture is cooled and filtered. The filtrate is the desired product.

EXAMPLE 2

A mixture of 188 parts of water and 313 parts of monoethanol amine is prepared and heated to about 52° C. whereupon 95 parts of boric acid is added over 30 minutes. A slightly exothermic reaction occurs and the temperature is kept below about 65° C. during addition and thereafter for about 45 minutes. Dodecanedoic acid (125 parts), sebacic acid (36.4 parts) and azelaic acid (59 parts) are added in the listed order while maintaining the temperature of the mixture between about 65°–70° C. Upon completion of the addition of the azelaic acid, an additional 123 parts of monoethanolamine are added over 15 minutes followed by mixing for one hour. The mixture then is filtered, and the filtrate is the desired product containing 1.84% of boron and 10.32% nitrogen.

EXAMPLE 3

A mixture of 40.2 parts of boric acid and 60 parts of water is charged to a reactor and heated to 45° C. Monoethanolamine (119 parts) is added in 20 minutes, and the reaction is exothermic to a temperature of 57° C. The mixture is maintained at a temperature of from 57°–62° C. for about 45 minutes whereupon 33 parts of dodecanedioic acid and 14.4 parts of sebacic acid are added. The temperature of the reaction mixture increases to 69° C., and 33.4 parts of monoethanol amine are added. The mixture then is maintained at a temperature of about 67°–71° C. for one hour and yields the desired product.

EXAMPLE 4

A mixture of 40.2 parts of boric acid and 60 parts of water is heated to about 48° C. whereupon 119 parts of monoethanol amine are added over a period of about 15 minutes. The temperature of the reaction mixture reaches 64° C. during the addition and is maintained at a temperature of from 60°–64° C. for about 30 minutes. To this mixture, there is added 26.7 parts of dodecanedioic acid, 8.1 parts of sebacic acid, 12.6 parts of azelaic acid and 33.3 parts of monoethanol amine. The exothermic reaction raises the temperature to 72° C., and the mixture is maintained at a temperature of from 60°–72° C. for about 15 minutes. Upon cooling, the desired product is obtained.

EXAMPLE 5

A mixture of 25.2 parts of boric acid and 126 parts of diethanolamine is heated to and maintained at a temperature of 85°–90° C. for one hour whereupon 33.3 parts of dodecanedioic acid, 9.9 parts of sebacic acid and 15.9 parts of azelaic acid are added. After a period of about five minutes, 39.9 parts of ethanolamine are added, and the reaction is exothermic to a temperature of 95° C. The mixture is maintained at 90°–95° C. for about one hour, 49.8 parts of water are added, and the mixture is cooled to yield the desired product.

EXAMPLE 6

The procedure of Example 3 is repeated except that 48 parts of dodecanedioic acid are utilized and the sebacic acid is omitted from the reaction mixture.

EXAMPLE 7

The procedure of Example 6 is repeated except that the ethanolamine is replaced by an equivalent amount of diethyl amine.

EXAMPLE 8

The procedure of Example 7 is repeated except that the diethanolamine is replaced by an equivalent amount of isopropanol amine.

The aqueous systems of the present invention contain a corrosion inhibiting amount of at least one of the inventive boron carboxylate salt mixtures. Mixtures of two or more salt mixtures can, of course, be used. Generally a corrosion-inhibiting amount is at least as much as about 0.01 weight percent of the system and as much as up to the saturation point of the inhibitor salt(s) in the aqueous system.

The aqueous systems of the present invention may also contain other additives when this appears desirable. In some cases it is advisable to add surfactants which may encourage cleaning and degreasing effects and insure satisfactory wetting of surfaces being treated with the system. The amount of surfactant used depends to some extent on its effectiveness but it may be up to 50% of the aforedescribed inhibitor salts.

Generally, the inhibitor salts of this invention are used to inhibit corrosion of ferrous metals and alloys containing such metals.

When light alloys or nonferrous metals are to be treated with the systems of this invention, it may be useful to include special inhibitors for the metals in question. For example, alkali borates or condensed phosphates are known to protect aluminum against attack. Benzotriazole or derivatives or analogs thereof protect nonferrous metals against attack. In certain cases it may also be desirable to add appropriate bacteriocide or fungicides to protect the aqueous systems from attack from bacteria or fungi. Various agents are known for these purposes, for example phenol derivative compounds which yield formaldehyde, triazines and quaternary ammonium compounds. Other desirable additives for the aqueous systems of this invention are known to those of skill in the art.

The following are examples of an aqueous system exhibiting improved corrosion inhibition.

| | Parts by Weight |
|---|---|
| Example A | |
| Product of Example 1 | 10 |
| Water | 90 |
| Example B | |
| Product of Example 2 | 10 |
| Triethanol amine | 15 |
| Water | 75 |
| Example C | |
| Product of Example 2 | 10 |
| Triethanol amine | 15 |
| Wetting agent | 5 |

-continued

| | Parts by Weight |
|---|---|
| Water | 70 |

What is claimed is:

1. Amine boron carboxylic salts useful as metal corrosion inhibitors for use in aqueous systems derived from (A) at least one polycarboxylic acid (I) corresponding to the formula $$R(COOH)_{2-3} \quad (I)$$

wherein R is an alkylene, alkenylene, alkynylene or hydroxyl alkylene group of about 4 to about 25 carbon atoms, (B) at least one monoamine (II) corresponding to the formula $$(R')_3N \quad (II)$$

wherein each R′ is independently hydrogen, a $C_{1-20}$ hydrocarbyl or a $C_{2-20}$ hydroxyl hydrocarbyl group, and (C) a boron compound comprising at least one of boric acid, boron trioxide, boron halides and esters of boric acid; wherein said amine boron carboxylic salts are formed by neutralizing said carboxylic acid (I) and said boron acid with said amine (II) at an elevated temperature which does not exceed 100° C.

2. The inhibitor of claim 1 wherein the polycarboxylic acid (I) is a dicarboxylic acid and R is an alkylene group containing from about 4 to 15 carbon atoms.

3. The inhibitor of claim 1 wherein at least one of R′ is a hydroxyl alkyl group.

4. The inhibitor of claim 3 wherein R is an alkylene group of about 4 to about 10 carbon atoms.

5. The inhibitor of claim 4 wherein the acid (I) is sebacic, azelaic, dodecanedioic acid or mixtures of two or more of said acids.

6. The inhibitor of claim 5 wherein the amine (II) is ethanol amine, diethanol amine, triethanol amine, propanol amine, di(propanol)amine, tri(propanol)amine, N,N-di(lower alkyl)ethanol or propanol amine or mixtures of two or more of said amines.

7. The inhibitor of claim 6 wherein the acid (I) is dodecanedioic acid and the amine (II) is ethanol amine.

8. The inhibitor of claim 1 wherein the acid (I) is a mixture of dodecanedioic, sebacic and azelaic acids and the amine is ethanolamine.

9. The inhibitor of claim 8 wherein (C) is boric acid.

10. The inhibitor of claim 1 wherein the salts are made from a mixture comprising, on a weight basis, about 15–30% of the polycarboxylic acid (I), about 40–55% of the monoamine (II) and about 5–20% of the boron compound.

11. The inhibitor of claim 1 comprising a mixture of an amine salt of the polycarboxylic acid and an amine salt of boric acid.

12. An aqueous system containing a corrosion inhibiting amount of at least one metal corrosion inhibitor as described in claim 1.

13. An aqueous system containing a corrosion inhibiting amount of at least one metal corrosion inhibitor as described in claim 2.

14. An aqueous system containing a corrosion inhibiting amount of at least one metal corrosion inhibitor as described in claim 4.

15. An aqueous system containing a corrosion inhibiting amount of at least one metal corrosion inhibitor as described in claim 7.

16. An aqueous system containing a corrosion inhibiting amount of at least one metal corrosion inhibitor as described in claim 9.

17. A method of inhibiting metal corrosion which comprises contacting the metal with the aqueous system described in claim 12.

18. A method of inhibiting metal corrosion which comprises contacting the metal with the aqueous system described in claim 15.

19. A method of inhibiting metal corrosion which comprises contacting the metal with the aqueous system described in claim 16.

* * * * *